US008286839B2

(12) United States Patent
Jasper

(10) Patent No.: US 8,286,839 B2
(45) Date of Patent: Oct. 16, 2012

(54) DISPENSING DEVICE

(75) Inventor: Bernhard Jasper, Waltrop (DE)

(73) Assignee: Aptar Dortmund GmbH, Dortmund (DE)

( * ) Notice: Subject to any disclaimer, the term of this patent is extended or adjusted under 35 U.S.C. 154(b) by 919 days.

(21) Appl. No.: 12/337,399

(22) Filed: Dec. 17, 2008

(65) Prior Publication Data

US 2010/0038385 A1 Feb. 18, 2010

(30) Foreign Application Priority Data

Aug. 12, 2008 (DE) ..... 10 2008 038 673

(51) Int. Cl.
*B65D 83/00* (2006.01)

(52) U.S. Cl. ..... 222/402.1; 222/95; 222/105; 222/386.5

(58) Field of Classification Search ..... 222/92, 222/95, 105, 107, 386.5, 402.1, 394, 402.22, 222/402.23, 402.24, 402.25
See application file for complete search history.

(56) References Cited

U.S. PATENT DOCUMENTS

| | | | | |
|---|---|---|---|---|
| 2,714,475 | A | | 8/1955 | Roehrich |
| 2,721,010 | A | | 10/1955 | Meshberg |
| 2,736,930 | A | | 3/1956 | Longley |
| 2,812,884 | A | | 11/1957 | Ward |
| 2,837,249 | A | | 6/1958 | Meshberg |
| 2,884,164 | A | | 4/1959 | Kleid |
| 2,980,301 | A | | 4/1961 | Gorter |
| 3,018,928 | A | | 1/1962 | Meshberg |
| 3,073,489 | A | | 1/1963 | Friedman |
| 3,104,785 | A | | 9/1963 | Beard, Jr. |
| 3,131,834 | A | | 5/1964 | Meshberg |
| 3,162,333 | A | | 12/1964 | Davidson |
| 3,258,369 | A | | 6/1966 | Blaich |
| 3,385,482 | A | | 5/1968 | Frangos |
| 3,507,586 | A | | 4/1970 | Gronemeyer et al. |
| 3,511,418 | A | | 5/1970 | Venus, Jr. |
| 3,542,253 | A | | 11/1970 | Weber et al. |
| 3,608,830 | A | * | 9/1971 | Ramella ..... 239/350 |
| 3,672,543 | A | * | 6/1972 | Roper et al. ..... 222/183 |
| 3,698,961 | A | | 10/1972 | Niemann |
| 3,706,393 | A | | 12/1972 | Curtis et al. |
| 3,726,442 | A | | 4/1973 | Davidson et al. |
| 3,795,350 | A | | 3/1974 | Shay |
| 3,796,356 | A | * | 3/1974 | Venus, Jr. ..... 222/212 |

(Continued)

FOREIGN PATENT DOCUMENTS

DE 2043415 9/1970

(Continued)

OTHER PUBLICATIONS

U.S. Appl. No. 12/303,807, filed Apr. 1, 2010, Neuhaus et al. U.S. Appl. No. 12/600,219, filed Mar. 13, 2010, Canfield et al.
U.S. Appl. No. 12/675,204, filed Apr. 29, 2010, Sonntag.
U.S. Appl. No. 12/675,229, filed Apr. 27, 2010, Bernhard.
Wacker Silicones, Geniomer® 200 Thermoplastic Silicone Elastomer, Jan. 10, 2005, XP002394023, retrieved from Internet address http://www.wacker.com/internet/webcache/en_US?PTM?TM?GENIOMER/GENIOMER_200_e.pdf on Aug. 8, 2006.

*Primary Examiner* — Frederick C. Nicolas
(74) *Attorney, Agent, or Firm* — Jason H. Vick; Sheridan Ross, PC

(57) ABSTRACT

A dispensing device for a cosmetic product is proposed. The dispensing device has a valve with a female valve element. The valve element has at least one engagement section for the positive and/or locking fastening of a male valve adapter which can be inserted into the valve element after assembly of the valve. Moreover, at its sealing side, the valve element forms a wall section which is enlarged in its inner diameter in order to permit faster filling.

27 Claims, 3 Drawing Sheets

U.S. PATENT DOCUMENTS

| | | | | |
|---|---|---|---|---|
| 3,820,689 | A | | 6/1974 | Cocita |
| 3,931,831 | A | | 1/1976 | French |
| 3,961,725 | A | * | 6/1976 | Clark ..... 222/1 |
| 3,991,916 | A | | 11/1976 | Del Bon |
| 4,035,303 | A | * | 7/1977 | Ufferfilge ..... 210/316 |
| 4,099,651 | A | | 7/1978 | Von Winckelmann |
| 4,222,501 | A | | 9/1980 | Hammett et al. |
| 4,304,749 | A | | 12/1981 | Bauer |
| 4,352,443 | A | | 10/1982 | Libit |
| 4,387,833 | A | * | 6/1983 | Venus, Jr. ..... 222/95 |
| 4,416,602 | A | | 11/1983 | Neumeister |
| 4,423,829 | A | * | 1/1984 | Katz ..... 222/95 |
| 4,458,832 | A | | 7/1984 | Corsette |
| 4,564,130 | A | | 1/1986 | Eulenburg |
| 4,830,229 | A | | 5/1989 | Ball |
| 4,867,347 | A | | 9/1989 | Wass et al. |
| 4,875,604 | A | | 10/1989 | Czech |
| 4,892,231 | A | | 1/1990 | Ball |
| 4,919,312 | A | | 4/1990 | Beard et al. |
| 4,969,577 | A | | 11/1990 | Werding |
| 5,007,556 | A | | 4/1991 | Lover |
| 5,007,596 | A | | 4/1991 | Iwahashi |
| 5,096,098 | A | | 3/1992 | Garcia |
| 5,123,571 | A | | 6/1992 | Rebeyrolle et al. |
| 5,190,190 | A | | 3/1993 | Fudalla |
| 5,197,637 | A | | 3/1993 | Naumann |
| 5,221,724 | A | | 6/1993 | Lie et al. |
| 5,271,432 | A | | 12/1993 | Gueret |
| 5,301,850 | A | | 4/1994 | Gueret |
| 5,360,145 | A | | 11/1994 | Gueret |
| 5,413,250 | A | | 5/1995 | Gueret |
| 5,454,488 | A | | 10/1995 | Geier |
| 5,465,872 | A | | 11/1995 | Gueret |
| 5,492,252 | A | | 2/1996 | Gueret |
| 5,505,341 | A | | 4/1996 | Gueret |
| 5,509,582 | A | | 4/1996 | Robbins, III |
| 5,687,884 | A | | 11/1997 | Bodin et al. |
| 5,728,333 | A | | 3/1998 | Tabata et al. |
| 5,732,855 | A | | 3/1998 | Van der Heijden |
| 5,743,441 | A | | 4/1998 | Baudin et al. |
| 5,769,283 | A | | 6/1998 | Owada et al. |
| 5,857,224 | A | | 1/1999 | Oberg et al. |
| 5,862,955 | A | | 1/1999 | Albini et al. |
| 5,868,287 | A | | 2/1999 | Kurokawa et al. |
| 5,873,491 | A | | 2/1999 | Garcia et al. |
| 5,875,936 | A | | 3/1999 | Turbett et al. |
| 5,875,939 | A | * | 3/1999 | Geier ..... 222/341 |
| 5,881,929 | A | | 3/1999 | Coerver, Jr. |
| 5,927,568 | A | | 7/1999 | De Nervo et al. |
| 5,975,381 | A | | 11/1999 | Revenu |
| 6,007,914 | A | | 12/1999 | Joseph et al. |
| 6,083,450 | A | | 7/2000 | Safian |
| 6,112,953 | A | | 9/2000 | Gueret |
| 6,116,475 | A | | 9/2000 | Delage |
| 6,145,707 | A | | 11/2000 | Baudin |
| 6,216,916 | B1 | | 4/2001 | Maddox et al. |
| 6,298,960 | B1 | | 10/2001 | Derr |
| 6,322,542 | B1 | | 11/2001 | Nilson et al. |
| 6,328,920 | B1 | | 12/2001 | Uchiyama et al. |
| 6,352,184 | B1 | * | 3/2002 | Stern et al. ..... 222/402.1 |
| 6,505,986 | B1 | | 1/2003 | Oder |
| 6,629,799 | B2 | | 10/2003 | Flores, Jr. |
| 6,756,004 | B2 | | 6/2004 | Davis et al. |
| 6,778,089 | B2 | | 8/2004 | Yoakum |
| 6,832,704 | B2 | | 12/2004 | Smith |
| 6,919,114 | B1 | | 7/2005 | Darras et al. |
| 6,966,465 | B2 | | 11/2005 | Kang |
| 7,775,461 | B2 | | 8/2010 | Laidler et al. |
| 7,780,045 | B2 | | 8/2010 | Rossignol |
| 7,854,355 | B2 | | 12/2010 | Rossignol |
| 7,913,877 | B2 | | 3/2011 | Neuhalfen |
| 2002/0037179 | A1 | | 3/2002 | Suzuki et al. |
| 2002/0051314 | A1 | | 5/2002 | Hayashi |
| 2002/0074355 | A1 | | 6/2002 | Lewis et al. |
| 2002/0190085 | A1 | | 12/2002 | Stanford |
| 2003/0071080 | A1 | | 4/2003 | Yquel |
| 2003/0230603 | A1 | | 12/2003 | Smith |
| 2005/0155980 | A1 | | 7/2005 | Neuhalfen |
| 2006/0060618 | A1 | | 3/2006 | Hoepner et al. |
| 2006/0231519 | A1 | | 10/2006 | Py et al. |
| 2006/0237486 | A1 | | 10/2006 | Kersten |
| 2007/0228082 | A1 | | 10/2007 | Jasper et al. |
| 2007/0272767 | A1 | | 11/2007 | Niggemann |
| 2008/0110941 | A1 | | 5/2008 | Foster et al. |
| 2008/0197152 | A1 | | 8/2008 | Neuhaus et al. |
| 2009/0166383 | A1 | | 7/2009 | Canfield |
| 2009/0212075 | A1 | | 8/2009 | Neuhaus et al. |
| 2009/0294480 | A1 | | 12/2009 | Canfield |
| 2009/0314810 | A1 | | 12/2009 | Neuhaus |
| 2010/0012680 | A1 | | 1/2010 | Canfield et al. |
| 2010/0108722 | A1 | | 5/2010 | Canfield et al. |
| 2010/0147898 | A1 | | 6/2010 | Blumenstein et al. |

FOREIGN PATENT DOCUMENTS

| | | |
|---|---|---|
| DE | 2920497 | 11/1980 |
| DE | 9307083 | 7/1993 |
| DE | 4210225 | 9/1993 |
| DE | 19851659 | 11/1998 |
| DE | 29820894 | 1/1999 |
| DE | 19744510 | 4/1999 |
| DE | 19832824 | 2/2000 |
| DE | 19950512 | 5/2001 |
| DE | 20203841 | 6/2002 |
| DE | 10308727 | 6/2004 |
| DE | 202004011219 | 11/2004 |
| DE | 202004011220 | 11/2004 |
| DE | 20200512684 | 11/2005 |
| EP | 0058700 | 9/1982 |
| EP | 0069738 | 1/1983 |
| EP | 0179538 | 4/1986 |
| EP | 0442858 | 8/1991 |
| EP | 0599301 | 6/1994 |
| EP | 0864371 | 9/1998 |
| EP | 0893356 | 1/1999 |
| EP | 0908395 | 4/1999 |
| EP | 0930102 | 7/1999 |
| EP | 1084669 | 3/2001 |
| EP | 1327478 | 7/2003 |
| EP | 1637232 | 3/2006 |
| FR | 1266391 | 7/1961 |
| FR | 2127774 | 10/1972 |
| FR | 2510069 | 1/1983 |
| FR | 2654079 | 11/1989 |
| FR | 2783667 | 3/2000 |
| FR | 2838108 | 10/2003 |
| GB | 1405546 | 8/1972 |
| GB | 1523732 | 9/1978 |
| GB | 2083142 | 3/1982 |
| GB | 2105729 | 3/1983 |
| GB | 2150226 | 6/1985 |
| GB | 2155435 | 9/1985 |
| GB | 2161222 | 1/1986 |
| JP | 07251884 | 3/1995 |
| JP | 09039467 | 2/1997 |
| WO | WO 96/16746 | 6/1996 |
| WO | WO 00/26007 | 5/2000 |
| WO | WO 00/44505 | 8/2000 |
| WO | WO 01/25116 | 4/2001 |
| WO | WO 02/079679 | 10/2002 |
| WO | WO 2004/022143 | 3/2004 |
| WO | WO 2004/073871 | 9/2004 |
| WO | WO 2004/073877 | 9/2004 |
| WO | WO 2005/000731 | 1/2005 |
| WO | WO 2005/123542 | 12/2005 |
| WO | WO 2005/123543 | 12/2005 |
| WO | WO 2006/123168 | 11/2006 |
| WO | WO 2006/128574 | 12/2006 |
| WO | WO 2007/062824 | 6/2007 |
| WO | WO 2007/104561 | 9/2007 |
| WO | WO 2009/030393 | 3/2009 |

* cited by examiner

DISPENSING DEVICE

CROSS REFERENCE TO RELATED APPLICATIONS

This application claims the benefit under 35 U.S.C. 119(a) to German Application No. 102008038673.1 filed Aug. 12, 2008, the entire disclosure of which is hereby incorporated by reference in its entirety.

BACKGROUND

The present invention relates to a dispensing device for a preferably cosmetic product as well as the use thereof.

The dispensing device is preferably used for a non-spraying delivery or dispensing of a preferably cosmetic product. However, a spraying delivery can also be provided for.

The term "cosmetic liquid" is to be understood, in a narrower sense, as cosmetics, hair spray, hair lacquer, a deodorant, a foam, particularly shaving foam, a gel, a color spray, a sun protection or skin care agent or the like or other cosmetic liquids, fluids, pastes, lotions, emulsions or the like. Preferably, however, in a broader sense, other body care products, cleaning products or the like, and even suspensions and fluids, particularly those with gas phases, are included as well. Moreover, other liquids and fluids, for example air improvers and particularly technical liquids and fluids as well such as rust removers and the like, can also be used. Nonetheless, for the sake of simplicity and due to the emphasized use, there is often only mention of cosmetic liquid in the following. Especially preferably, the proposed dispensing device is used for the storage and delivery of a gel, particularly shaving gel, or a paste, particularly toothpaste, or the like.

DESCRIPTION OF RELATED ART

EP 0 320 510 B1 discloses a dispensing device with a valve which has a valve housing. The valve housing is provided with a tubular section with side wings extending radially to mutually opposing sides. Welded onto the side wings and the tubular section by means of thermal welding. The valve is held by a plate which is connected to an outer container in a gas-tight manner. As a result of gas in the outer container, pressure is exerted on the inner container in order to be able to output a cosmetic product contained in the inner container. The valve has a female valve element into which a tubular connector of a dispensing head can engage. By depressing the valve element, the valve opens against the force of a return spring.

BRIEF SUMMARY

One aspect of the present invention is directed toward an improved dispensing device which is more universally utilizable vis-à-vis the prior art.

According to the invention, the dispensing device has a valve with a female valve element, with the valve element being provided with at least one engagement section for the positive and/or locking fastening of a male valve adapter which can be inserted into the valve element after assembly of the valve. This permits a subsequent installation of the valve adapter in order to convert or rebuild the valve as a male valve. Resulting from the positive and/or locking, preferably permanent, fastening of the male valve adapter in the valve element is a defined fixation and secure mounting. Accordingly, the proposed dispensing device can be used universally, and a high level of safety can be reached when used on the valve adapter. In particular, as a result of the secure fastening of the valve adapter, a dispensing head mounted on the valve adapter can also be held in a correspondingly secure manner.

According to another aspect of the present invention which can also be implemented independently, a return spring associated with the valve element ends at a distance from the valve adapter, so that the return spring does not radially enclose the valve adapter and the valve element can be embodied with as large an inner diameter as possible for accommodating the valve adapter or a filling nozzle. Accordingly, the proposed dispensing device or its valve can be filled with a larger flow cross section and hence at greater speed relative to the prior art.

BRIEF DESCRIPTION OF THE DRAWINGS

Further advantages, features, characteristics and features of the present result from the claims and the following description of a preferred embodiment on the basis of the drawing.

DETAILED DESCRIPTION

While the figures are not true-to-scale, the same reference symbols are used for same or similar parts, with corresponding or comparable characteristics and advantages being achieved even when a repeated description has been omitted.

Figure 1:
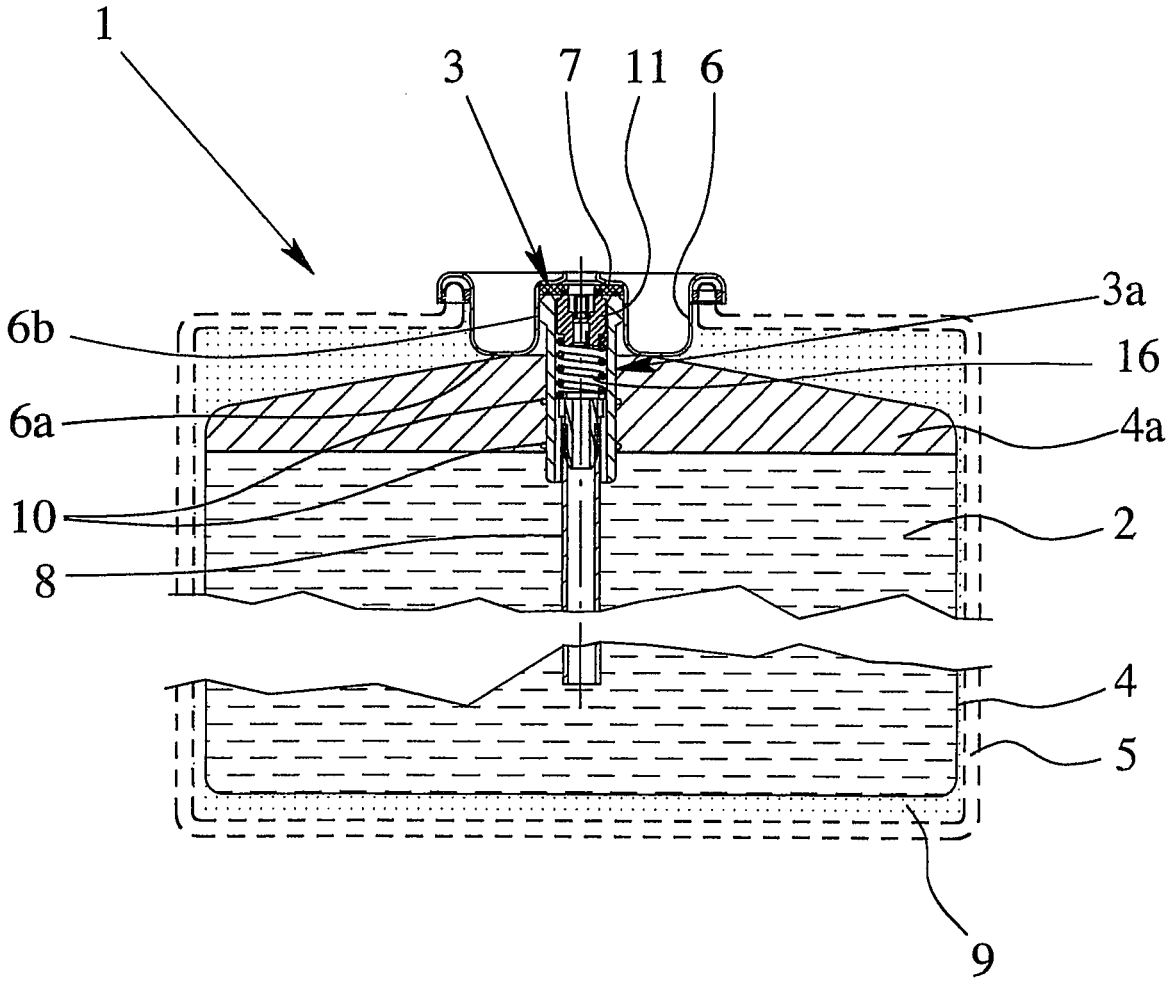
FIG. 1 shows a schematic section of a proposed dispensing device.

FIG. 1 shows, in a schematic section, an exemplary dispensing device 1 for dispensing a preferably cosmetic product 2 in the sense mentioned at the outset. In particular, the product 2 is shaving gel, toothpaste or the like.

The dispensing device 1 has a valve 3 via which the product 2 can be dispensed. As needed, the valve 3 can be embodied as a dosing valve or the like. It can be opened, for example, by depressing a dispensing head attached thereto (not depicted) or in another suitable manner. In particular, the product 2 can be dispensed in liquid form, pasty form, as foam, as gel or the like via the valve 3 or a dispensing head or the like attached thereto.

The dispensing device 1 has a flexible inner container 4, as indicated schematically in FIG. 1. The inner container 4 is particularly embodied as a bag. Preferably, it is a folded container or bag which has been fused shut. However, other constructive solutions are also possible.

Especially preferably, the wall of the inner container 4 is film-like and/or formed by a composite film. The wall is preferably diffusion-tight at least to a great extent. For example, the wall or film can have an aluminum layer, aluminum vapor deposition or the like as well as other layers, particularly layers consisting of a polyolefin.

The dispensing device 1 further preferably has an outer container 5 which is merely indicated with a broken line in FIG. 1. The inner container 4 is preferably accommodated together with the valve 3 in the outer container 5. In the depicted example, the valve 3 is provided with a plate 6 or held thereby which, in turn, is connected with the outer container 5, particularly in a gas-tight manner. Especially preferably, the plate 6 forms a tightly sealing cover or seal of the outer container 5.

The plate 6 is preferably fabricated from metal. In principle, however, it can also consist of plastic or any other suitable material, particularly a composite material.

The valve 3 has a valve housing 3*a* which is connected with the plate 6 or held thereby. In the depicted example, the plate 6 has a side 6*a*—here an underside, inner side, flat side or a ring-shaped area—facing the inner container 4 or interior of the outer container 5 which is provided with a preferably middle, outwardly protruding recess 6*b*.

The valve 3 or valve housing 3*a* is accommodated or held with one end in the recess 6*b*, particularly by means of clamping, nonpositively or positively, for example through spraying or injection, caulking, welding, adhesion or the like. The valve 3 or valve housing 3*a* preferably terminates on the outlet side in the recess 6*b*. Preferably, a particularly ring-shaped seal 7 is arranged between the bottom of the recess 6*b* and the front side of the valve housing 3*a* in order to seal off the valve housing 3*a* on the outside vis-à-vis the plate 6 and hence to be able to seal the outer container 5 in a gas-tight manner. However, other constructive solutions are also possible.

The inner container 4 is connected in a gas-tight manner with the valve housing 3, particularly at the end area or inlet end facing away from the plate 6. This end area or this inlet end protrudes particularly into the interior of the outer container 5 and particularly into the interior of the inner container 4.

The inner container 4 contains the preferably cosmetic product 2 to be dispensed. To facilitate the extraction of the product 2 from the inner container 4, an optional riser 8, particularly a tube or the like, can be connected to the valve 3 on the inlet side. The riser 8 is particularly inserted into or onto a connector or the like on the inlet side formed by the valve housing 3*a* or otherwise appropriately connected or connectable with the valve housing 3*a* on the inlet side.

The outer container 5 is filled with a pressurized gas 9, which is indicated with dots in FIG. 1. The gas 9 is particularly air or another suitable pressurized gas, optionally also liquid gas or the like.

The gas pressure prevailing in the outer container 5 acts on the outside of the flexible inner container 4 such that, when the valve 3 is opened, the product 2 is delivered via the valve 3 and an optionally connected dispensing head or the like. Upon removal or dispensing of the product 2, the inner container 4 collapses.

The inner container 4 is, as already mentioned, connected, particularly fused, to the valve housing 3*a* in a gas-tight manner. Especially preferably, the inner container 4 is ultrasound welded with the valve housing 3*a*. This enables a substantially more energy-saving, quicker and/or more cost-effective manufacture of the dispensing device 1 in comparison to the thermal welding provided for in the prior art. However, it is also possible in principle to connect the inner container 4 with the valve housing 3 in another suitable manner, for example through another type of bonding, clamping, injection, adhesion or the like.

Figure 2:
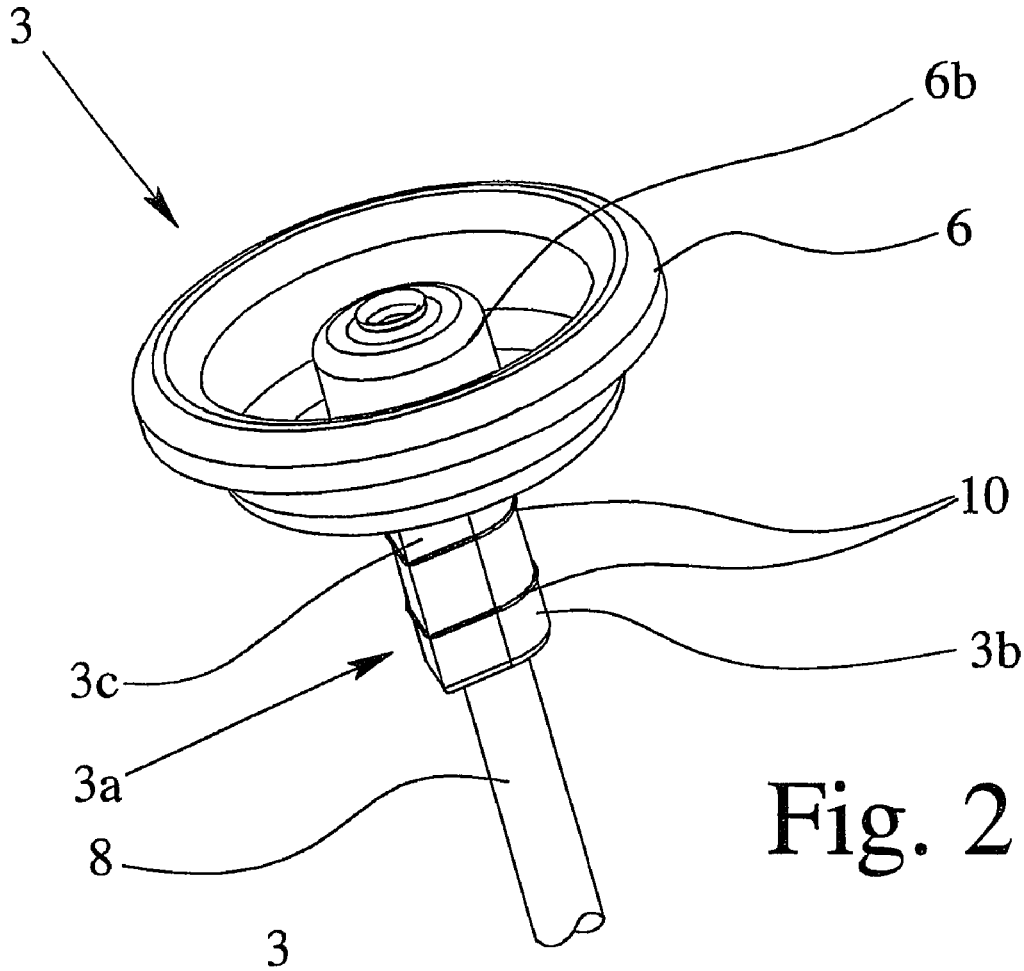
FIG. 2 shows a schematic, perspective view of a valve of the dispensing device.
Figure 3:
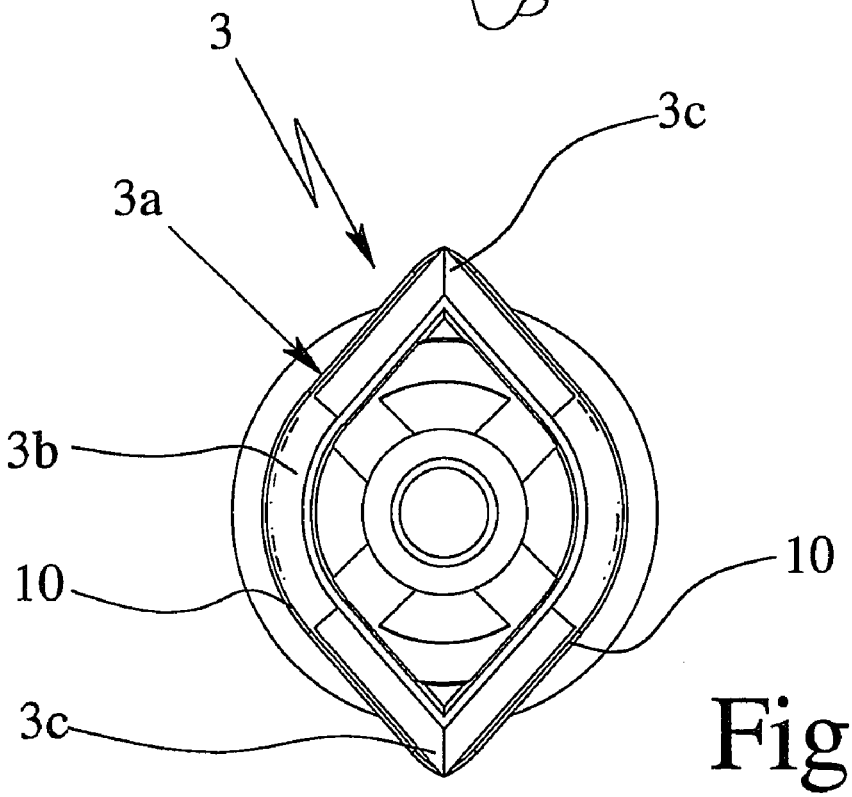
FIG. 3 shows a view of the valve from below.

In the depicted example, the valve 3 or valve housing 3*a* has an at least substantially tubular section 3*b* and, particularly, two side wings 3*c* arranged on opposing sides of the section 3*b* and extending particularly radially and along the tubular section 3*b*. This can be seen, in particular, in the perspective view of the valve 3 according to FIG. 2 and the bottom view of the valve 3 without plate 6 according to FIG. 3.

The side wings 3*c* taper preferably toward their free edges. In particular, the two wings 3*c* extend outward or radially to a point. This prevents or minimizes the formation of a gap in the area of the free edges and the inner container walls meeting the edge starting from the tubular area 3*b*.

The inner container 4 is connected, particularly ultrasound welded, with the valve housing 3*a* particularly in the area of the preferably tubular section 3*b* and the side wings 3*c*. In the depicted example, the inner container 4 preferably has an upper connection or weld seam 3*a* arranged in the area of the valve 3, with said seam 3*a* being indicated in FIG. 1 by hatching and extending, for example, over the entire width of the inner container 4. Preferably, the valve housing 3*a* is welded into this weld seam 4*a* with the tubular section 3*b* and the side wings 3*c*. However, other constructive solutions are also possible.

In order to achieve as great a diffusion tightness of the valve housing 3*a* as possible, which is to say to minimize a possible diffusion of the gas 9 or of components of the gas 9 such as oxygen through the valve housing 3*a* into a valve chamber with the product 2, where the gas 9 or a component of the gas 9 can react with the product 2, especially after lengthy storage, the inner container 4 is connected or welded with the valve housing 3*a* preferably over a length of at least 70%, particularly 80% or greater, of the longitudinal extension of the valve housing 3*a* or valve 3, thus covering the valve housing 3*a* in a diffusion-tight manner.

Alternatively, or in addition, the inner container 4 is connected or welded with the valve housing 3*a* preferably up to the side 6*a* of the plate 6 facing or adjacent to the inner container 4 in order to increase the diffusion tightness of the valve housing 3*a*.

As a result of the increase in diffusion tightness, it is possible in principle to reduce the wall thickness of the valve housing 3*a*. This allows, for example, at least for a more cost-effective manufacture.

According to another likewise independent aspect of the present invention, at least one weld bead 10 is preferably arranged or formed, particularly molded, on the valve housing 3*a* prior to welding with the inner container 4. During welding, the weld bead 10 is covered by the inner container 4. The weld bead 10 is particularly designed to be land-like or rib-like and/or ongoing or continuous. The weld bead 10 is designed, for example, to be substantially triangular, rectangular, trapezoidal or convex or arched in its cross section.

Especially preferably, a welding of the inner container 4 with the valve housing 3*a* occurs along the weld bead 10, so that a defined, particularly at least substantially linear connection between the valve housing 3*a* on the one hand and the inner container 4 on the other hand is made possible. In this manner, a defined and tight connection between the valve housing 3*a* and the inner container 4 can be achieved with relatively little ultrasound energy. However, the weld bead 10 can be used not only during ultrasound welding, but during other types of welding as well.

The weld bead 10 preferably has a height and/or width of at least 0.2 mm and/or of at most 0.8 mm, especially preferably less than 0.5 mm. Very especially preferably, the height and/or width is essentially 0.3 mm.

Especially preferably, the weld bead 10 terminates in an edge or tip which is at least substantially rectangular in cross section. The weld bead 10 is designed to be particularly substantially triangular or trapezoidal in cross section or is provided with an at least substantially triangular or trapezoidal tip toward the free end.

Especially preferably, the weld bead 10 extends at least substantially around a periphery of the valve housing 3*a* or of a surface of the valve housing 3*a* to be connected with the inner container 4.

Especially preferably, the weld beads 10 extend to the free longitudinal edges of the side wings 3*c*, optionally even somewhat beyond these laterally, in order to ensure a good seal and connection with the inner container 4 after welding in the area of these edges as well.

Especially preferably, the weld bead 10 forms a closed loop. However, it can also be a finite land, rib or the like, i.e. one which is not closed.

Instead of a continuous weld bead 10, several sections which overlap each other and/or only have small gaps between each other, for example, can also be provided.

Especially preferably, at least two weld beads 10 are provided which extend spaced apart from or parallel to each other. In this manner, a kind of "double seal" or two-fold linear connection can be achieved between the valve housing 3*a* on the one hand and the inner container 4 on the other hand.

During welding of the inner container 4 with the valve housing 3*a*, a fusing of the weld bead 10 or weld beads 10 occurs, which results in a flattening out and connection with the inner container 4.

In FIG. 1, the weld beads 10 are only depicted for purposes of clarity. In reality, the weld beads 10 are at least substantially no longer present or visible in the welded-on inner container 4.

Especially preferably, the valve housing 3*a* and at least the inner layer of the inner container 4 are made from the same material. This facilitates the connecting, particularly the welding. This is not absolutely necessary, however. It is also possible for different materials to be used which can be connected with each other, particularly by means of welding or in another suitable manner, as already described.

If the inner container 4 is manufactured from a single-layer material, this material also forms the inner layer. The term "inner layer" is therefore to be understood such that it comprises a single-layer design.

In the depicted example, the valve housing 3*a* and/or the inner layer of the inner container 4 preferably consists of polyethylene. Compared to the prior art, this material displays a significantly higher diffusion tightness. Moreover, this material can also be welded by means of ultrasound.

Alternatively, polyamide can particularly also be used for the valve housing 3*a* and/or the inner layer of the inner container 4. In particular, corresponding advantages result here as with the use of polyethylene.

It should be noted that the valve housing 3*a* need not consist entirely of the named material. Rather, the valve housing 3*a* can also be manufactured from another material according to a design variant (not depicted). For example, according to one design variant (not depicted), it is possible to manufacture the valve housing 3*a* in the area in which it is not connected with the inner container 4 or is covered thereby from another material or to provide it with a covering made from another material, with the other material having, in particular, a greater diffusion tightness or other advantageous characteristics. For example, it is possible to inject a diffusion-tight covering, especially preferably by means of so-called "bi-injection," i.e., injection of the other material in the same injection mold against a first material.

Figure 4:
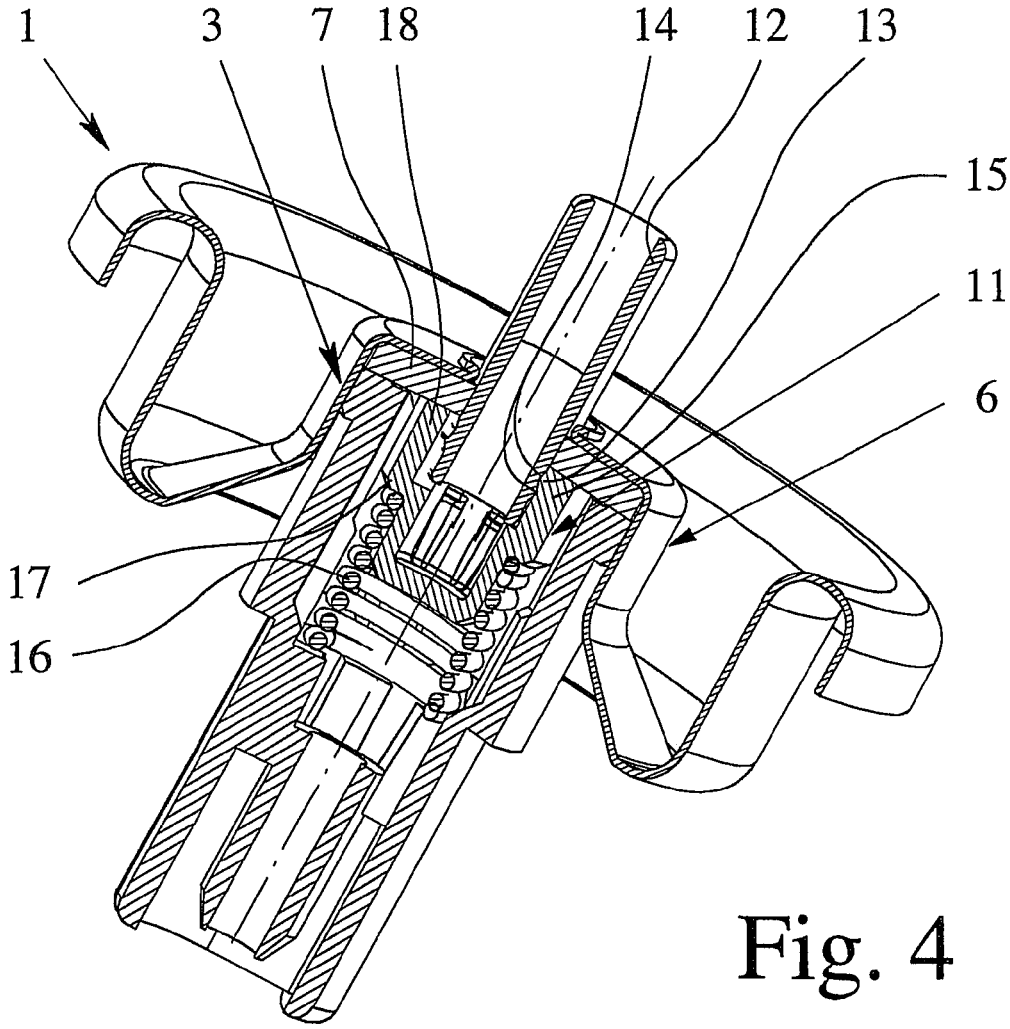
FIG. 4 shows a sectional view of the valve with inserted valve adapter.

The dispensing device 1 or the valve 3 has a female, particularly pot-like, valve element 11 as shown in the schematic section according to FIG. 4. In the depicted example, the valve element 11 is pretensioned against the seal 7 by means of a return spring 16. When the valve 3 is closed, the valve element 11 lies against the seal 7 on the front side. However, other constructive solutions are also possible here.

Figure 5:
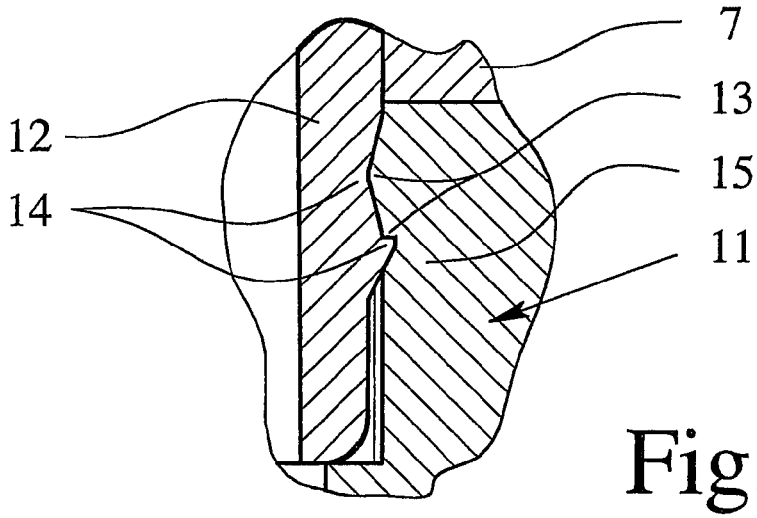
FIG. 5 shows an enlarged section from FIG. 4 which shows the connection between valve element and valve adapter.

According to the present invention, the valve element 11 is designed for the positive and/or locking fastening of a male valve adapter 12, which can be inserted into the valve element 11. For this purpose, the valve element 11 has, in particular, at least one engagement section 13 which can be made to engage with an engagement section 14 of the valve adapter 12 preferably embodied to be at least substantially complementary thereto, particularly such that both engagement sections 13, 14 engage in each other radially as indicated in the enlargement according to FIG. 5.

Especially preferably, the engagement section 13 and/or the engagement section 14 is groove-like, land-like, rib-like, lip-like or similarly formed. However, other constructive solutions are also possible.

As needed, several axially spaced, particularly radially acting engagement possibilities between the valve adapter 12 and the valve element 11 can also be provided. In particular, several engagement sections 13 and 14 are then respectively provided.

The valve adapter 12 is preferably at least substantially tubular and has at least one engagement section 14, preferably on a periphery or the outside. Optionally, several engagement sections are distributed over the periphery. Especially preferably, however, it has a continuous engagement section 14. Particularly, the valve adapter 12 is designed to be at least substantially rotationally symmetrical, so that no particular orientation of the valve adapter 12 to the valve needs to be maintained during assembly. However, it is also possible for the valve adapter 12 to be connectable with the valve element 11 in a torsionally rigid manner—then preferably with a certain rotational tolerance.

The valve adapter 12 can be inserted from the outside into the valve element 11 after assembly of the valve 3 of the dispensing device 1, particularly such that the valve adapter 12 is held positively and/or in a locking manner, particularly non-detachably.

The valve element 11 preferably has several engagement sections 13 particularly distributed over an inner periphery.

Especially preferably, the valve element 11 has ribs 15 preferably running axially distributed over an inner periphery (in FIG. 4, only one rib 15 is in section) which accommodate or hold the valve adapter 12. Especially preferably, the engagement sections 13 of the valve element 11 are each formed by the ribs 15.

The ribs 15 are preferably spaced apart from each other or distributed over the inner periphery or provided with large intermediate spaces such that, when the valve 3 is opened, the dispensed product 2 is able to flow along from the seal 7 between the ribs 15 along the valve adapter 12 on the outside up to the open end of the valve adapter 12 in the valve element 11.

Preferably, the valve element 11 directly forms an abutment 17, here particularly by means of a ring-shaped collar, a ring flange or the like, for the return spring 16, which is supported with the other end particularly on the inside at the valve housing 3*a*. According to an aspect of the present invention which can also be implemented independently, the abutment 17 is spaced axially from the dispensing-side or seal-side end of the valve element 11, so that the valve element 11 is able to form a relatively long wall section 18 between the seal 7 and the abutment 17 and/or the return spring 18 does not enclose the inserted valve adapter 12 on the outside.

Especially preferably, the spacing of the abutment 17 from the seal 7 or from the seal-side end of the valve element 11 is substantially larger than the maximum insertion depth of the valve adapter 12.

Especially preferably, the axial length of the wall section 18 or the aforementioned spacing is at least 20%, particularly about 40 to 50% or more of the axial length of the valve element 11.

Particularly, a provision is made that the abutment 17 is spaced apart from a dispensing-side end of the valve element 11 such that the valve element 11 forms a wall section 18 with an enlarged inner diameter.

In this manner, a substantially faster filling of the dispensing device 1 or of the valve 3 and hence a more universal utilization is made possible.

The valve element 11 or the wall section 18 is preferably embodied such that an inner diameter of preferably at least 3 mm is formed (between the ribs 15 as well) which is as large as possible. The large inner diameter allows for substantially faster filling or the use of a larger-sized filling needle. Accordingly, the valve adapter 12 can be larger in its outer diameter and inner diameter in order to also allow for faster filling compared to the prior art even when the valve adapter 12 is used.

Individual features and constructive solutions of the described embodiments can also be combined with each other as desired and/or used in other dispensing devices.

LIST OF REFERENCE SYMBOLS

1 dispensing device
2 product
3 valve
3*a* valve housing
3*b* tubular section
3*c* side wings
4 inner container
4*a* weld seam
5 outer container
6 plate
6*a* side (underside plate)
6*b* recess
7 seal
8 riser
9 gas
10 weld bead
11 valve element
12 valve adapter
13 engagement section (valve element)
14 engagement section (valve adapter)
15 rib
16 return spring
17 abutment
18 wall section

The invention claimed is:

1. Dispensing device for dispensing a liquid, with a valve provided with a plate, wherein the valve has a female depressible and movable valve element for opening the valve, wherein the valve element is provided with at least one engagement section for the positive or locking fastening of a male valve adapter which can be inserted into the valve element after assembly of the valve, and wherein after assembly of the valve, wherein the valve is in fixed connection with the plate or a cover for mounting to a container containing the liquid, the male valve adapter is insertable and connectable in a positive or locking manner with the valve element, wherein the male valve adapter has at least one engagement section on the outside, which is smaller in diameter than the diameter of a substantially cylindrical body of the male valve adapter.

2. Dispensing device as set forth in claim 1, wherein the valve adapter has an engagement section which acts together with the engagement section of the valve element.

3. Dispensing device as set forth in claim 2, wherein both engagement sections engage in each other radially.

4. Dispensing device as set forth in claim 1, wherein at least one of the valve element and the valve adapter has several engagement sections distributed over a periphery.

5. Dispensing device as set forth in claim 1, wherein the valve element has ribs distributed over a periphery which accommodate or hold the valve adapter.

6. Dispensing device as set forth in claim 5, wherein the ribs are provided with engagement sections.

7. Dispensing device as set forth in claim 1, wherein the engagement section is embodied as an annular groove, ring land or ring collar or a peripheral section thereof.

8. Dispensing device as set forth in claim 2, wherein the engagement section is embodied as an annular groove, ring land or ring collar or a peripheral section thereof.

9. Dispensing device as set forth in claim 2, wherein the engagement section of the valve element on the one hand and the engagement section of the valve adapter on the other hand are embodied such that they are at least substantially complementary to each other.

10. Dispensing device as set forth in claim 1, wherein the valve adapter can be accommodated or held by the valve element in a non-detachable manner.

11. Dispensing device as set forth in claim 1, wherein a return spring supported on an abutment of the valve element is associated with the valve element, with the abutment being spaced apart from a dispensing-side end of the valve element such that the valve element forms a wall section with an enlarged inner diameter.

12. Dispensing device as set forth in claim 1, wherein the valve has a valve housing and the dispensing device has a flexible inner container which is connected with the valve housing.

13. Dispensing device as set forth in claim 12, wherein the inner container is bag-like.

14. Dispensing device as set forth in claim 12, wherein the inner container welded with the valve housing.

15. Dispensing device as set forth in claim 1, wherein the dispensing device has an outer container with which the valve housing is connected in a gas-tight manner or into which the valve is incorporated.

16. Dispensing device as set forth in claim 15, wherein the inner container is arranged in the outer container and is under external pressure or gas pressure.

17. Dispensing device as set forth in claim 1, with a gel, particularly shaving gel, or a paste, particularly toothpaste, as product.

18. Dispensing device as set forth in claim 1, wherein the engagement section of the valve element is radially protruding from the valve element and engaging into a radially indented engagement section of the valve adapter, and wherein the valve adapter comprises a radially protruding engagement section engaging into a radially intended engagement section of the valve element.

19. Dispensing device as set forth in claim 1, wherein the valve adapter is held or secured at the valve element by an undercut.

20. The dispensing device of claim 1, wherein the liquid is a cosmetic liquid.

21. The dispensing device of claim 1, wherein the male valve adapter comprises substantially smooth cylindrical surfaces or shapes.

22. The dispensing device of claim 1, wherein the male valve adapter comprises an outer maximum diameter less than an opening of the plate or the cover.

23. Dispensing device for dispensing a liquid, with a valve provided with a plate, wherein the valve has a female depressible and movable valve element for opening the valve, wherein the valve element is provided with at least one engagement section for the positive or locking fastening of a male valve adapter which can be inserted into the valve element after assembly of the valve, and wherein after assembly of the valve, namely after fixed connection with the plate or cover for mounting to a container containing the liquid, the male valve adapter is insertable and connectable in a positive or locking manner with the valve element, wherein the male valve adapter has at least one engagement section on the outside, which is smaller in diameter than the diameter of a substantially cylindrical body of the male valve adapter.

24. Dispensing device as set for in claim 23, wherein the liquid is a cosmetic liquid.

25. Dispensing device as set for in claim 23, wherein the male valve adapter comprises substantially smooth cylindrical surfaces or shape.

26. Dispensing device as set for in claim 23, wherein the male valve adapter comprises an outer maximum diameter less than an opening of the plate or cover.

27. Dispensing device for dispensing a liquid, with a valve which has a female depressible and movable valve element for opening the valve, wherein the valve element is provided with at least one engagement section for the positive or locking fastening of a male valve adapter which can be inserted with an introduction end into the valve element after assembly of the valve, wherein the male valve adapter comprises a substantially cylindrical outer shape, wherein the male valve adapter has one engagement section on the outside, which is larger in diameter than the diameter of the substantially cylindrical shape, and wherein an inclined section reduces the larger diameter to a diameter smaller than the diameter of the substantially cylindrical shape towards the introduction end, wherein the male valve adapter has at least one engagement section on the outside, which is smaller in diameter than the diameter of a substantially cylindrical body of the male valve adapter.

* * * * *